US005845339A

United States Patent [19]

Ashley et al.

[11] Patent Number: 5,845,339

[45] Date of Patent: Dec. 8, 1998

[54] COLLAPSIBLE VISOR OR CAP

[76] Inventors: Lari J. Ashley; James B. Ashley, both of 3825 W. Hatcher Rd., Phoenix, Ariz. 85051

[21] Appl. No.: 774,149

[22] Filed: Dec. 26, 1996

Related U.S. Application Data

[60] Provisional application No. 60/009,241 Dec. 26, 1995.

[51] Int. Cl. [6] ..... A42B 1/20

[52] U.S. Cl. ..... 2/195.6; 2/12; 2/171.03

[58] Field of Search ..... 2/12, 175.5, 195.1, 2/195.6, 195.5, 10, 171.03

[56] References Cited

U.S. PATENT DOCUMENTS 3,357,026 12/1967 Weigandt ..... 2/195.6
4,293,958 10/1981 Zauner ..... 2/12
4,549,316 10/1985 Johnson ..... 2/195.1
5,581,808 12/1996 Garza ..... 2/12

*Primary Examiner*—Diana Biefeld
*Attorney, Agent, or Firm*—Gregory J. Nelson

[57] ABSTRACT

Headwear, such as visor or cap, which has a bill for shielding the wearer's face, which bill extends from the headband that encircles the wearer's head. The bill is attached to the headband along its inner edge and has a wire-like, flexible member which extends along the outer edge or periphery of the bill. The wire-like member serves to maintain the bill in a fully extended condition when worn but has sufficient flexibility to permit the bill and headband to be folded into a compact, collapsed condition and to fit into a small pouch or pocket for storage.

7 Claims, 2 Drawing Sheets

FIG. 3
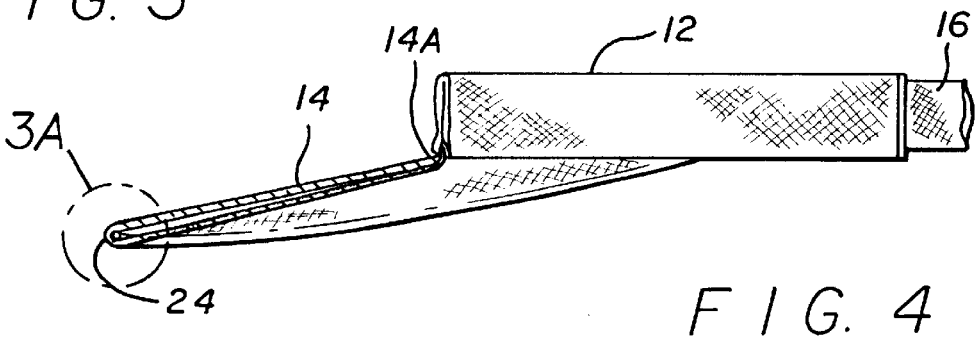
FIG. 4
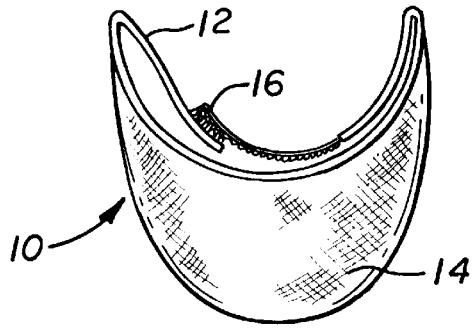
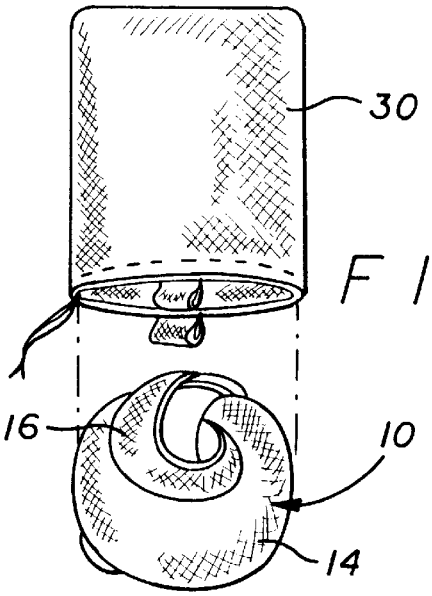
FIG. 5
FIG. 4A
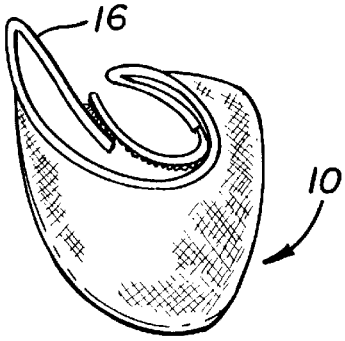
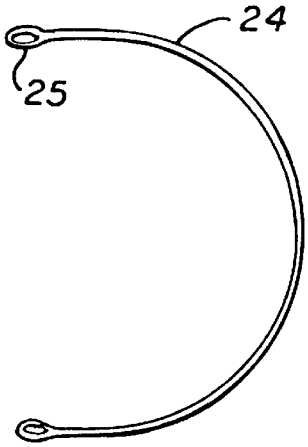
FIG. 6
FIG. 4B
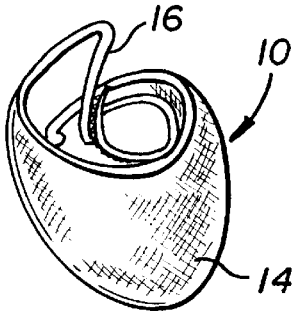

COLLAPSIBLE VISOR OR CAP

CROSS REFERENCE TO PRIOR APPLICATION

This application is a complete application based on provisional application Ser. No. 60/009,241, filed Dec. 26, 1995 entitled Collapsible Visor and Cap.

BACKGROUND OF THE INVENTION

Field of the Invention

This invention relates generally to wearing apparel, in particular relates to headwear such as visors and caps which are collapsible into a compact size for storage when not in use.

It is well known that visors and caps are commonly worn by golfers and other persons involved in outdoor activities,. These visors and caps are generally constructed having a headband that encircles the wearer's head. A bill is attached to the headband that shields the person's face from the elements. The bill is usually a rigid member formed of stiff material such as plastic or cardboard. The U.S. Pat. Nos. 4,293,958 to Zauner and 5,105,476 to Cox disclose visors with bills made of stiff material. Since the bill is a rigid member, is not possible to fold the visor or the cap of the type represented by these patents into a shape that fits into a small pouch or a compact size to facilitate carrying the visor or cap in a pocket or handbag.

U.S. Pat. No. 2,931,046 to H. D. Klein discloses a visor having a bill that includes a deformable wire stiffener that extends along the outer edge thereof. The deformable wire permits the bill to be deformed and then retained in any desired configuration but is not intended to allow the visor to be collapsed and then restored to its original shape or condition.

U.S. Pat. No. 2,495,041 to M. Weiss discloses a beach hat with an endless flexible member disposed along its outer periphery. The Weiss hat may be collapsed and inverted into a small bag. The Weiss hat is generally annular in shape.

U.S. Pat. No. 54,049 to W. H. White, and U.S. Pat. No. 4,165,542 to McLaughlin disclose headwear that may be collapsed and stowed in a pouch.

SUMMARY OF THE INVENTION

It is a broad object of the present invention to provide headwear that may be easily folded into a collapsed condition to facilitate storage when not in use and which, when unfolded, is restored to its normal wearing condition.

Briefly, the present invention provides a visor and cap which have a bill for shielding a person's face and a headband that encircles a person's head. The bill is attached to the headband along its inner edge and has a wire-like flexible member which extends along the outer edge or periphery of the bill. The wire-like flexible member serves to maintain the bill in a fully extended condition when worn, but has sufficient flexibility to permit the bill and headband to be folded into compact, collapsed condition to fit into a small pouch or pocket for storage. Preferably the bill is a soft fabric construction and the wire-like member is disposed between the fabric layers of the bill and extends from one side of the bill to the other. The above and other objects and advantages of the present invention will be more fully appreciated from the following description, claims, and drawings in which;

BRIEF DESCRIPTION OF THE DRAWINGS

FIG. 3 is a sectional view taken along line 3—3 of FIG. 2;

FIG. 4, 4A, 4B, and 4C are top views of the visor showing the sequential steps of converting the cap from an in-use position to a fully collapsed condition;

FIG. 5 shows a visor according to the present invention in the fully collapsed position in which it may be inserted in a pouch for carrying and storage; and FIG. 6 is a top view of the flexible reinforcing member.

DETAILED DESCRIPTION OF THE DRAWINGS

Figure 1:
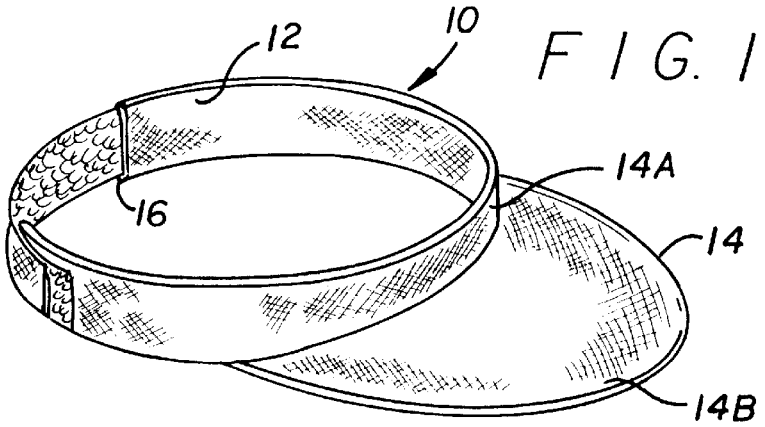
FIG. 1 is a perspective view of a visor embodying the present invention shown in the use position.
Figure 1A:
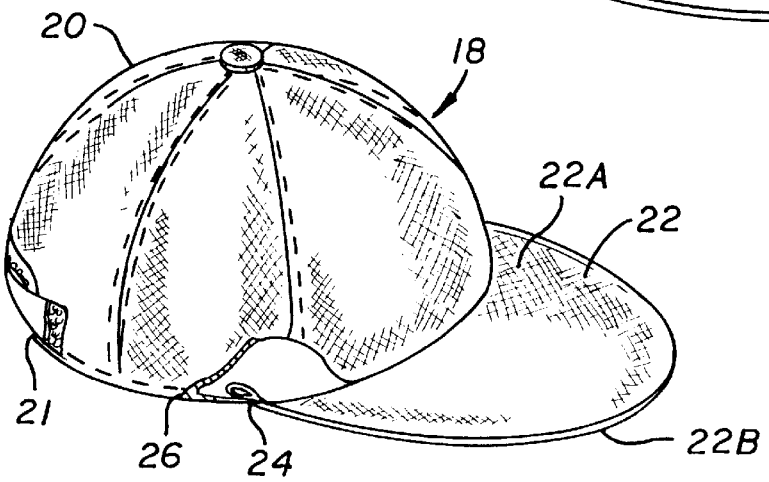
FIG. 1A is a perspective view of a cap embodying the present invention shown in use position.

The present invention relates to headwear that may be adapted for use with visor type headwear as seen in FIG. 1 or caps as seen in FIG. 1A. Referring to FIG. 1, the visor 10 includes a headband 12 and a bill 14 which is attached to the headband 12 along inner arcuate edge 14A. The headband 12 is preferably formed of a flexible fabric or material and includes a conventional size adjustment device 16 located along the rear portion of the visor. The size adjustment device 16 may be a closure section as a mating fabric loop and hook members of the type sold under the mark Velcro. The adjustment device may also be an elastic band on a strap and buckle or a pair of straps with selectively engageable holes and pins as are well known.

The cap 18 shown in FIG. 1A includes a head covering crown portion 20 and a bill 22 attached to the crown portion along its inner edge 22A. The crown portion of the cap is preferably formed of a flexible material and includes a size adjustment device 21 at the rear of the hat which adjustment device may be similar to the adjustment device 16 shown in connection with the visor 10 in FIG. 1.

The visor bill 14 and cap bill 22 each have a flexible member 24 extending along their outer edges 14B and 22B respectively. The flexible member is seen in FIG. 6. Preferably the flexible member is a wire-like member such as stainless steel wire rope of the type sold by McCaster-Carr Supply Company of Los Angeles Calif., type 302 and 304. A preferred size for type 302 and 304 wire rope which is 3/32" in diameter . Type 302 wire rope is a 1×7 strand and type 304 is a type 7×7 strand. These sizes of wire rope have moderate flexibility and excellent strength characteristics and permit the cap or visor to be collapsed and when expanded, returns the bill to its original shape. The wire rope also allows the bill to be deformed in any direction.

While wire rope has been found to work well, the member 24 could be made of fiberglass with flexibility, memory and strength characteristics that are equivalent to those of wire rope. It is to be understood that many other materials such as composites, metal and plastics will provide the desired characteristics.

Figure 2:
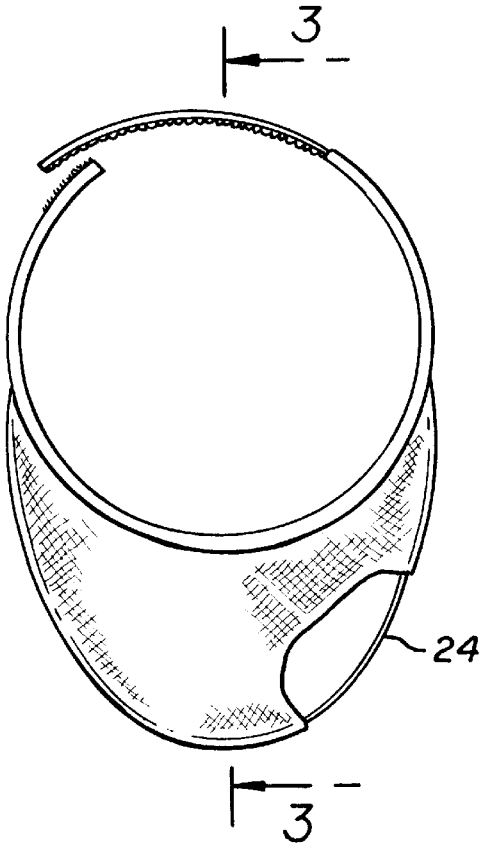
FIG. 2 is a top view of the visor shown in FIG. 1.
Figure 4C:
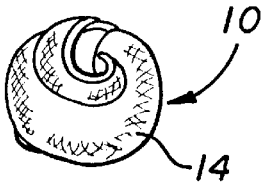
Figure 3A:
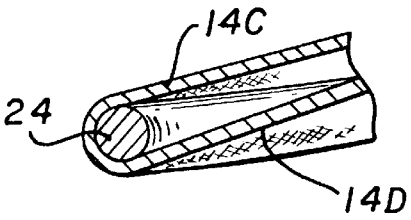
FIG. 3A is an enlarged detailed view of a portion of the visor bill as shown in FIG. 3.

As best seen in FIG. 2 and 3A, the flexible member 24 is disposed inside the bills 14 and 22 between opposed fabric layers or plys 14C and 14D which may be nylon, cotton or equivalent fabric. The member 24 extends along the periphery of the visor from its attachment point at one side of the cap or visor to the other side. In a normal condition, the flexible member retains the visor in the fully extended position, as shown in FIGS. 1 and 2. When it is desired to collapse the visor of the cap 18 or visor 10 into position adjacent to bill as shown in FIG. 4, the bill is folded into a partially collapsed condition as shown in FIGS. 4A and 4B with the opposite edges of the cap or visor folded inwardly. Finally, the visor or cap is folded in a fully collapsed position shown in FIG. 4C, which is accomplished by twisting the bill over the crown or visor portion. Twisting of the bill is accommodated by its construction utilizing fabric and the flexible wire reenforcing member.

In the fully collapsed position shown in FIG. 4C, the visor will easily fit into a small pouch such as pouch 30 seen in FIG. 5 for storage and carrying. Alternately, the collapsed visor or cap can be stowed in a pocket of a garment or a pocket of a golf bag or in a hand bag. When removed and unfolded, the flexible member will return to its normal shape without having a tendency to return to its collapsed position. This causes the cap or visor to be returned to a normal wearing condition. The member is generally non-deformable and will return to its normal condition. The cap or visor, according to the invention, may be provided in various colors and patterns dependent on what fashion dictates. Logos may be applied as is customary.

As seen in FIG. 6, the opposite ends of the reenforcing member 24 are provided with small tabs or loops 25. These loops or tabs are provided to make the sewing operation and construction of the hat or cap easier since the tabs or loops provide a convenient attachment location for the sewer. The tabs or loops also reduce localized wear where the tabs or loops and fabric are in contact. It may also be desirable to coat the wire rope with plastic to prevent wear. As seen in FIG. 1A, once the item is constructed, the loop or tabs are preferably sewn into the lower edge seam 26 of the visor or cap.

It will be understood by those skilled in the art that various changes, alterations and modifications may be made to the invention described herein. To the extent such changes, alterations, and modifications do not depart from the spirit and scope of the appended claims, they are intended to be encompassed therein.

We claim:

1. Collapsible headwear comprising:

(a) a headband;

(b) a bill attached to the headband and extending forwardly in a normal use-position to shade the face of a wearer, said bill having upper and lower fabric layers peripherally joined together along their forward edges each of which extend from one side of the headband to the other;

(c) a flexible, generally non-deformable wire rope member disposed between said fabric layers along said forward edge whereby said headwear may be collapsed on itself into a compact condition for storage and unfolded to the normal use-position in which the flexible member supports the bill.

2. The collapsible headwear of claim 1 wherein said head band has a size adjustment feature.

3. The collapsible headwear of claim 1 wherein the wire rope is comprised of multiple strands.

4. The collapsible headwear of claim 1 wherein said wire rope is coated with a plastic material.

5. The collapsible headwear of claim 1 further including a pouch defining a pocket sized to receive said headwear in said compact condition.

6. Collapsible headwear comprising:

(a) a headband;

(b) a bill attached to the head-engaging band and extending forwardly in a normal use-position to shade the face of the wearer, said bill having an upper and lower fabric layer peripherally joined together along a forward edge extending generally from one side of the headband to the other;

(c) a flexible generally non-deformable member disposed between said fabric layers along said forward edge whereby said hat or visor may be collapsed on itself into a compact condition for storage and unfolded to the normal use-position in which the flexible member supports the bill, said flexible member having opposite ends and having tabs at said ends which are attached to said headband.

7. Collapsible headwear comprising:

(a) a headband;

(b) a bill attached to the headband and extending forwardly in a normal use-position to shade the face of a wearer, said bill having upper and lower fabric layers peripherally joined together along their forward edges each of which extend from one side of the headband to the other;

(c) a flexible, generally non-deformable wire-like member disposed between said fabric layers along said forward edge whereby said headwear may be collapsed on itself into a compact condition for storage and unfolded to the normal use-position in which the flexible member supports the visor bill.

* * * * *